US009892693B1

(12) United States Patent
Kumar et al.

(10) Patent No.: US 9,892,693 B1
(45) Date of Patent: Feb. 13, 2018

(54) CONFIGURABLE LIGHTING SYSTEM

(71) Applicant: Cooper Technologies Company, Houston, TX (US)

(72) Inventors: Jyoti Kumar, Tyrone, GA (US); Philip Dean Winters, Senoia, GA (US); Steven Walter Pyshos, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 15/685,358

(22) Filed: Aug. 24, 2017

Related U.S. Application Data

(63) Continuation-in-part of application No. 15/435,141, filed on Feb. 16, 2017.

(60) Provisional application No. 62/297,424, filed on Feb. 19, 2016.

(51) Int. Cl.

| | |
|---|---|
| ***H05B 33/08*** | (2006.01) |
| ***G09G 3/34*** | (2006.01) |
| ***F21S 8/04*** | (2006.01) |
| ***F21V 21/14*** | (2006.01) |

(52) U.S. Cl.
CPC ..... *G09G 3/3413* (2013.01); *F21S 8/04* (2013.01); *F21V 21/14* (2013.01); *H05B 33/086* (2013.01); *H05B 33/0866* (2013.01)

(58) Field of Classification Search
CPC .. H05B 33/086; H05B 33/0866; H05B 37/02; F21V 21/14; F21S 8/04; G09G 3/3413
USPC .... 315/151, 152, 209 R, 224–226, 291, 294, 315/307, 308
See application file for complete search history.

(56) References Cited

U.S. PATENT DOCUMENTS

| | | | | |
|---|---|---|---|---|
| 7,416,312 | B1 | 8/2008 | McDermott | |
| 8,172,415 | B2 | 5/2012 | Wegh | |
| 8,317,362 | B2 | 11/2012 | Ku et al. | |
| 8,598,793 | B2 * | 12/2013 | Yan | H05B 33/086 315/151 |
| 2006/0220586 | A1 | 10/2006 | Latham | |
| 2014/0210357 | A1 | 7/2014 | Yan et al. | |
| 2015/0054410 | A1 | 2/2015 | Sanders et al. | |
| 2017/0019973 | A1 | 1/2017 | Beck et al. | |
| 2017/0086265 | A1 | 3/2017 | Akiyama et al. | |

* cited by examiner

*Primary Examiner* — Jimmy Vu
(74) *Attorney, Agent, or Firm* — King & Spalding LLP

(57) ABSTRACT

A luminaire can include a housing having at least one outer surface that forms a cavity. The luminaire can also include an aperture that traverses the at least one outer surface of the housing. The luminaire can further include a substrate disposed within the cavity. The luminaire can also include an electrical connector disposed on the substrate adjacent to the aperture. The luminaire can further include a switch coupled to the electrical connector, where switch has multiple positions, where each position of the switch corresponds to a discrete correlated color temperature (CCT) output by multiple light sources of the luminaire.

20 Claims, 14 Drawing Sheets

FIG. 1F

| Switch 1 | Switch 2 | LED 1 3,000K | LED 2 4,000K | Resulting Color Temp |
|---|---|---|---|---|
| On | Off | On | On | 3,500K |
| Off | On | On | On | 3,500K |
| On | On | On | Off | 3,000K |
| Off | Off | Off | On | 4,000K |

CONFIGURABLE LIGHTING SYSTEM

CROSS REFERENCE TO RELATED APPLICATIONS

This application is a continuation-in-part of and claims priority to U.S. patent application Ser. No. 15/435,141, titled "Configurable Lighting System" and filed on Feb. 16, 2017, which claims priority to U.S. Provisional Patent Application No. 62/297,424 filed Feb. 19, 2016, in the name of Steven Walter Pyshos and Raymond Janik and entitled "Configurable Lighting System". The entire contents of these aforementioned applications are hereby incorporated herein by reference.

TECHNICAL FIELD

Embodiments of the technology relate generally to lighting systems and more specifically to lighting systems that can be readily configured to produce illumination of different color temperatures.

BACKGROUND

For illumination applications, light emitting diodes (LEDs) offer substantial potential benefit associated with their energy efficiency, light quality, and compact size. However, to realize the full potential benefits offered by light emitting diodes, new technologies are needed.

With luminaires that incorporate incandescent or fluorescent technology, some flexibility can be obtained by swapping lamps to meet user preferences. In such luminaires, lamp selection can provide flexibility in terms of correlated color temperature (CCT or color temperature) and light output (lumen output). For example, a compact fluorescent downlight might accept 6-, 32-, and 42-watt lamps in 2700, 3000, and 3500 K CCT. Additionally, changing lamp position and focal point in a reflector of an incandescent or fluorescent fixture can change the fixture spacing criteria (SC) of a luminaire.

In contrast, conventional light-emitting-diode-based luminaires typically offer reduced flexibility when the luminaire's light-emitting-diode-based light source is permanently attached to the luminaire. Stocking conventional light-emitting-diode-based luminaires at distribution to accommodate multiple configurations that users may desire can entail maintaining a relatively large or cumbersome inventory.

Need is apparent for a technology to provide a light emitting diode system that can adapt to various applications, for example by delivering multiple color temperatures, multiple lumens, and/or multiple photometric distributions. Need further exists for a capability to enable a single luminaire to be stocked at distribution and then quickly configured according to application parameters and deployment dictates. Need further exists for luminaires that are both energy efficient and flexible. A capability addressing one or more such needs, or some other related deficiency in the art, would support improved illumination systems and more widespread utilization of light emitting diodes in lighting applications.

SUMMARY

In some aspects of the disclosure, a system can configure a luminaire for providing illumination of a selected color temperature, a selected lumen output, or a selected photometric distribution based on an input. The input may be field selectable or may be selectable at a distribution center or at a late stage of luminaire manufacture, for example.

In some aspects of the disclosure, the luminaire can comprise at least two light sources having different color temperatures. In a first configuration, the luminaire can produce illumination of a first color temperature using a first one of the light sources. In a second configuration, the luminaire can produce illumination of a second color temperature using a second one of the light sources. In a third configuration, the luminaire can produce illumination of a third color temperature using both of the first and second the light sources. The third color temperature may be between the first and second color temperatures. The value of the third color temperature within a range between the first and second color temperatures can be controlled by manipulating the relative amounts of light output by the first and second light sources. That is, adjusting the lumen outputs of the first and second light sources can define the color temperature of the illumination produced by the luminaire in the third configuration.

In some aspects of the disclosure, the luminaire can comprise at least two light sources having different lumen outputs. In a first configuration, the luminaire can produce illumination of a first lumen output using a first one of the light sources. In a second configuration, the luminaire can produce illumination of a second lumen output using a second one of the light sources. In a third configuration, the luminaire can produce illumination of a third lumen output using both of the first and second light sources.

In some aspects of the disclosure, the luminaire can comprise at least two light sources having different photometric distributions. In a first configuration, the luminaire can produce illumination of a first photometric distribution using a first one of the light sources. In a second configuration, the luminaire can produce illumination of a second photometric distribution using a second one of the light sources. In a third configuration, the luminaire can produce illumination of a third photometric distribution using both of the first and second light sources.

In some aspects of the disclosure, a circuit and an associated input to the circuit can configure a luminaire for providing illumination having a selected property, for example a selected color temperature, a selected lumen output, or a selected photometric distribution. The input can be settable to a first number of states. The circuit can map the first number of states into a second number of states that is less than the first number of states. For example, the input can have four states and the circuit can map these four states into three states. The three states can correspond to three different values of the illumination property, for example three different color temperatures, three different lumen outputs, or three different photometric distributions.

The foregoing discussion of controlling illumination is for illustrative purposes only. Various aspects of the present disclosure may be more clearly understood and appreciated from a review of the following text and by reference to the associated drawings and the claims that follow. Other aspects, systems, methods, features, advantages, and objects of the present disclosure will become apparent to one with skill in the art upon examination of the following drawings and text. It is intended that all such aspects, systems, methods, features, advantages, and objects are to be included within this description and covered by this application and by the appended claims of the application.

Figure 1A:
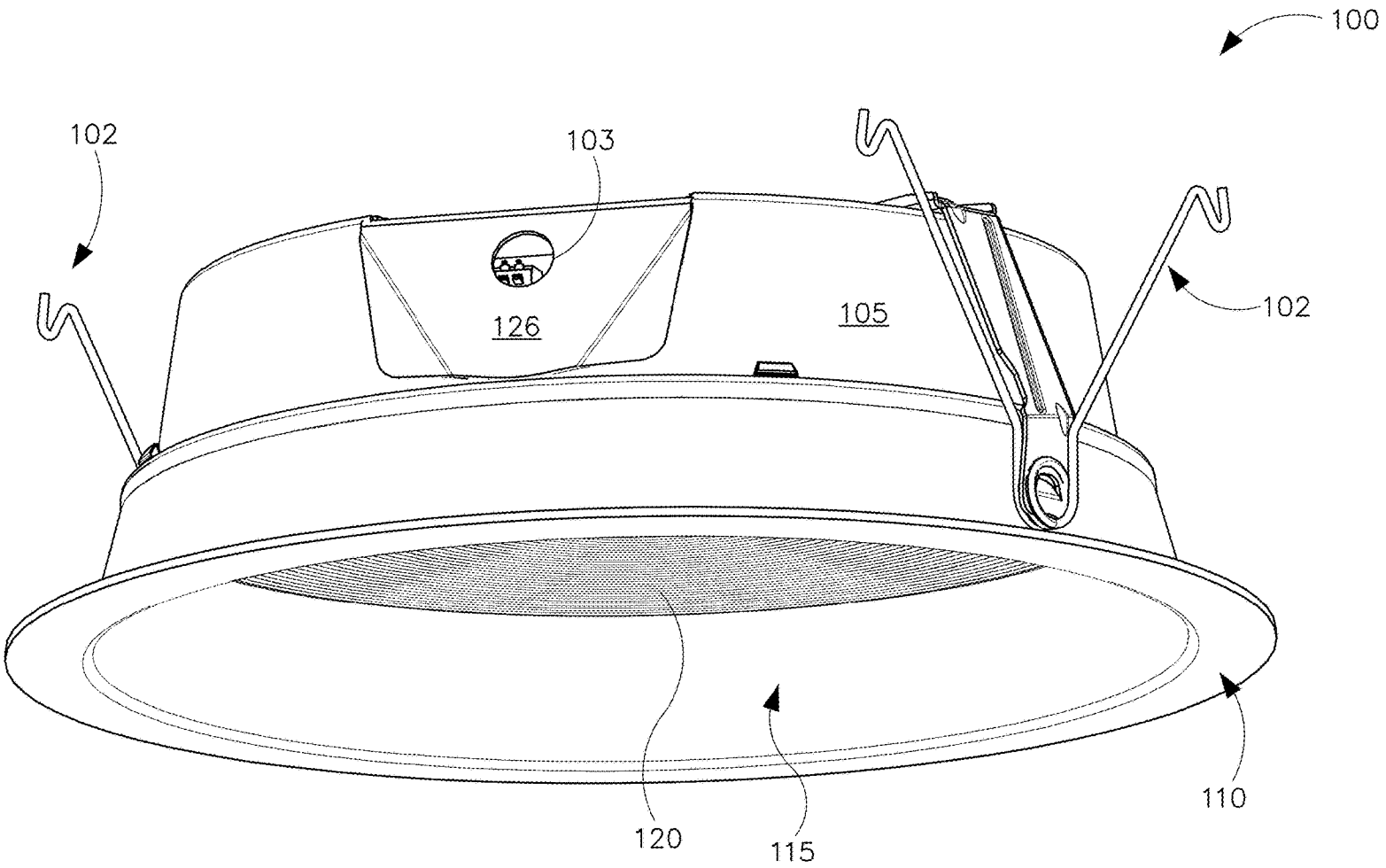
FIGS. 1A, 1B, 1C, 1D, 1E, 1F, 1G, 1H, 1I, 1J, and 1K (collectively FIG. 1) illustrate views of a luminaire in accordance with some example embodiments of the disclosure.

Many aspects of the disclosure can be better understood with reference to the above drawings. The drawings illustrate only example embodiments and are therefore not to be considered limiting of the embodiments described, as other equally effective embodiments are within the scope and spirit of this disclosure. The elements and features shown in the drawings are not necessarily drawn to scale, emphasis instead being placed upon clearly illustrating principles of the embodiments. Additionally, certain dimensions or positionings may be exaggerated to help visually convey certain principles. In the drawings, similar reference numerals among different figures designate like or corresponding, but not necessarily identical, elements.

DETAILED DESCRIPTION OF EXAMPLE EMBODIMENTS

In some example embodiments of the disclosure, a luminaire can comprise multiple groups of light emitting diodes of different color temperatures and a constant current power supply for powering the light emitting diodes. The power supply can utilize a switching scheme that can turn each group of light emitting diodes on and off to change the color temperature of the luminaire. In some example embodiments, the power supply can further vary the relative intensities of the light emitting diodes to manipulate the color temperature of the luminaire within a range.

For example, the luminaire can comprise a 3,000 K group of light emitting diodes and a 4,000 K group of light emitting diodes. When only the 3,000 K group is on, the luminaire can deliver 3,000 K illumination. When only the 4,000 K group is on, the luminaire can deliver 4,000 K illumination. When the 3,000 K group and the 4,000 K group are both on, the luminaire can deliver 3,500 K illumination. If the 4,000 K group of light emitting diodes is concurrently operated at a low lumen output and the 3,000 K group is operated at a high lumen output, the luminaire may deliver illumination of another selected color temperature, for example 3,100 K.

In some example embodiments, a controller can adjust lumen output automatically to maintain constant delivered lumens across multiple color temperatures or to suite application requirements. The controller implements the adjustment utilizing programmable driver current and/or via turning on and off various groups of light emitting diodes. Configurable color temperature or lumen output can function in combination with integral dimming, for example to facilitate interface with building automation, sensors, and dimmers.

In some example embodiments, luminaires can achieve an additional level of flexible configuration at a distribution center using interchangeable optics. For example, primary optics can provide medium distribution (e.g. spacing criteria equals 1.0), while a diffuser or concentrator lens can be used to achieve wide distribution (e.g. spacing criteria equals 1.4), and narrow distribution (e.g. spacing criteria equals 0.4).

In some example embodiments, a luminaire's configuration of delivered lumens and color temperatures can be set at the factory, at distribution, or in the field. To meet current and emerging code compliance, performance markings on a luminaire can indicate and correspond to the desired setting. Economical, field-installed nameplates can identify the various electrical and optical performance ratings and, when installed, permanently program the delivered lumens and color temperature. Other settings, such as dimming protocols, can likewise be configured. The interface between the nameplate and internal logic can use mechanical, electrical or optical means, for example.

Accordingly, in some embodiments of the disclosure, the technology provides product markings and supports regulatory compliance. For example, nameplates can indicate energy codes and rebate opportunities, for compliance with product labeling and to facilitate compliance confirmation by local authorities who may have jurisdiction. Further, luminaires that include example switches can be subject to meeting certain standards and/or requirements. For example, Underwriters Laboratories (UL), the National Electric Code (NEC), the National Electrical Manufacturers Association (NEMA), the International Electrotechnical Commission (IEC), the Federal Communication Commission (FCC), the Illuminating Engineering Society (IES), and the Institute of Electrical and Electronics Engineers (IEEE) set standards as to luminaires. Use of example embodiments described herein meet (and/or allow a corresponding luminaire to meet) such standards when required.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of configurable lighting systems will be described more fully hereinafter with reference to the accompanying drawings, in which example embodiments of configurable lighting systems are shown. Configurable lighting systems may, however, be embodied in many different forms and should not be construed as limited to the example embodiments set forth herein. Rather, these example embodiments are provided so that this disclosure will be thorough and complete, and will fully convey the scope of configurable lighting systems to those of ordinary skill in the art. Like, but not necessarily the same, elements (also sometimes called components) in the various figures are denoted by like reference numerals for consistency.

Terms such as "first", "second", "third", "fourth", "fifth", "top", "bottom", "side", and "within" are used merely to distinguish one component (or part of a component or state of a component) from another. Such terms are not meant to denote a preference or a particular orientation, and are not meant to limit embodiments of configurable lighting systems. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Referring now to FIG. 1, multiple views of the luminaire 100 are shown. FIG. 1A illustrates a side perspective view of the luminaire 100. FIG. 1B illustrates a top perspective view of the luminaire 100. FIG. 1C illustrates a view of the light-emitting bottom of the luminaire 100, showing a lens 120 in a light-emitting aperture 115 of the luminaire 100. FIG. 1D illustrates a view of the light-emitting bottom of the luminaire 100 with the lens 120 removed from the light-emitting aperture 115 of the luminaire. FIG. 1E illustrates a view of the light-emitting bottom of the luminaire 100 with the lens 120 and an associated reflector 130 removed from the light-emitting aperture 115 of the luminaire. FIG. 1F illustrates a cutaway perspective view of the luminaire 100. FIG. 1G illustrates another cutaway perspective view of the luminaire 100. FIG. 1H illustrates another cutaway view of the luminaire 100. FIGS. 1I, 1J, and 1K provide detailed views of a portion of the luminaire 100 comprising a cover 126 and an associated access aperture 129 for providing internal access to the luminaire 100. In FIG. 1I, the cover 126 is fully removed. In FIG. 1J, the cover 126 is positioned adjacent the access aperture 129, for example in connection with attachment or removal of the cover 126. In FIG. 1K, the cover 126 is attached to the luminaire 100.

Figure 1B:
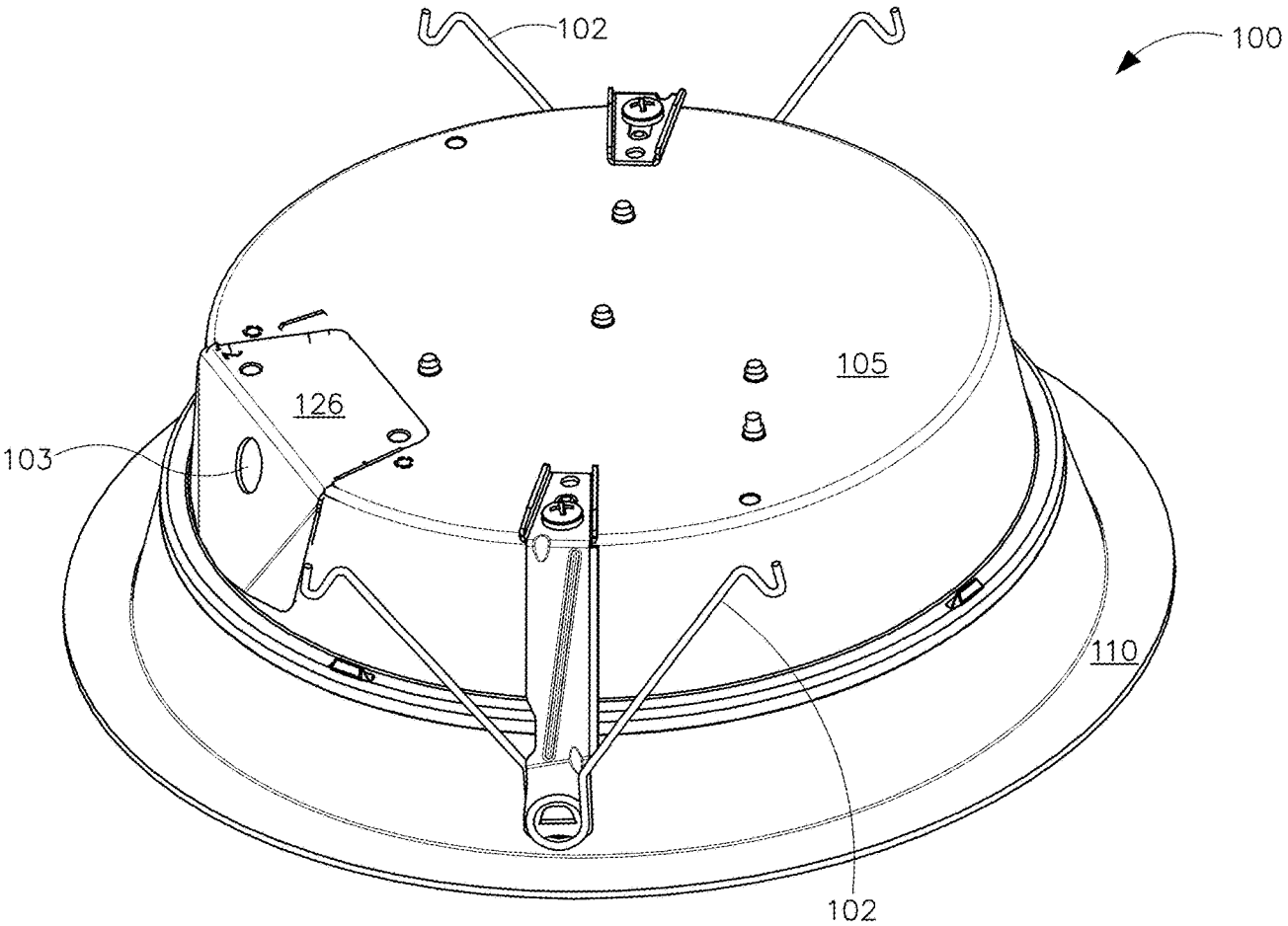
Figure 1C:
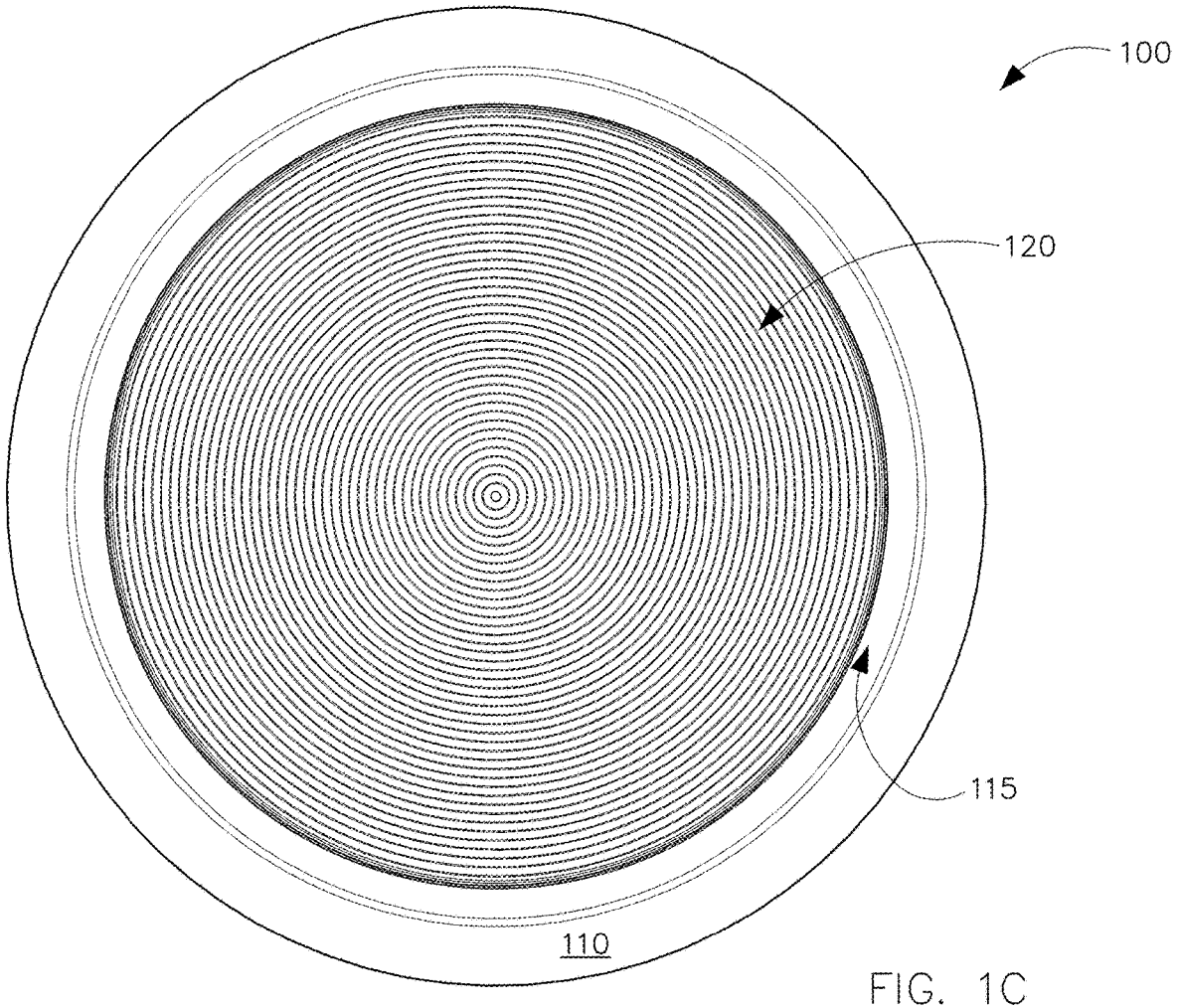
Figure 1E:
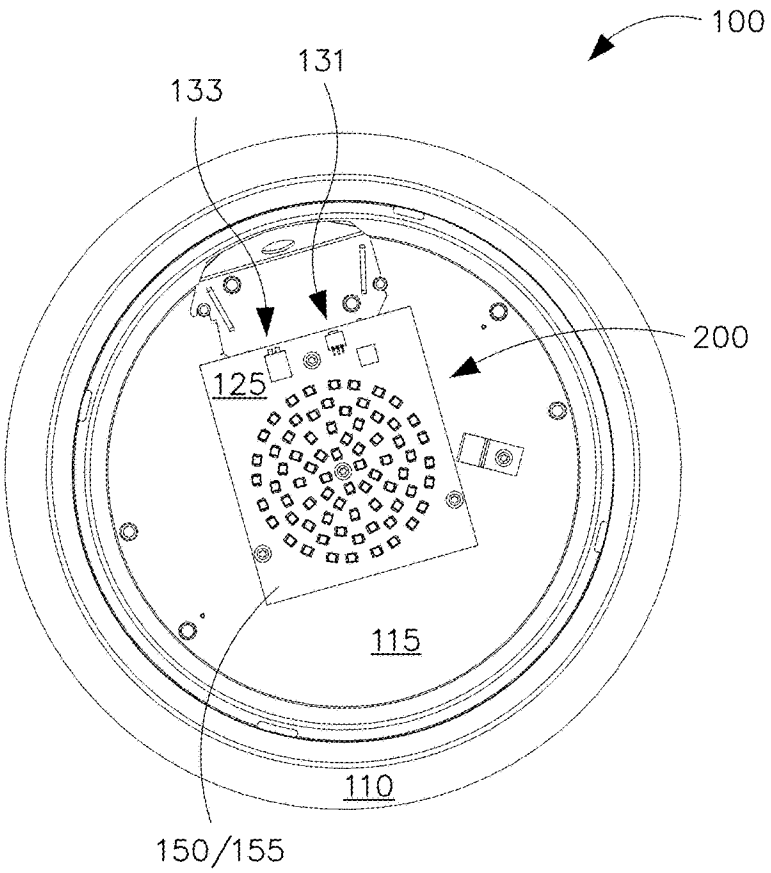
Figure 1D:
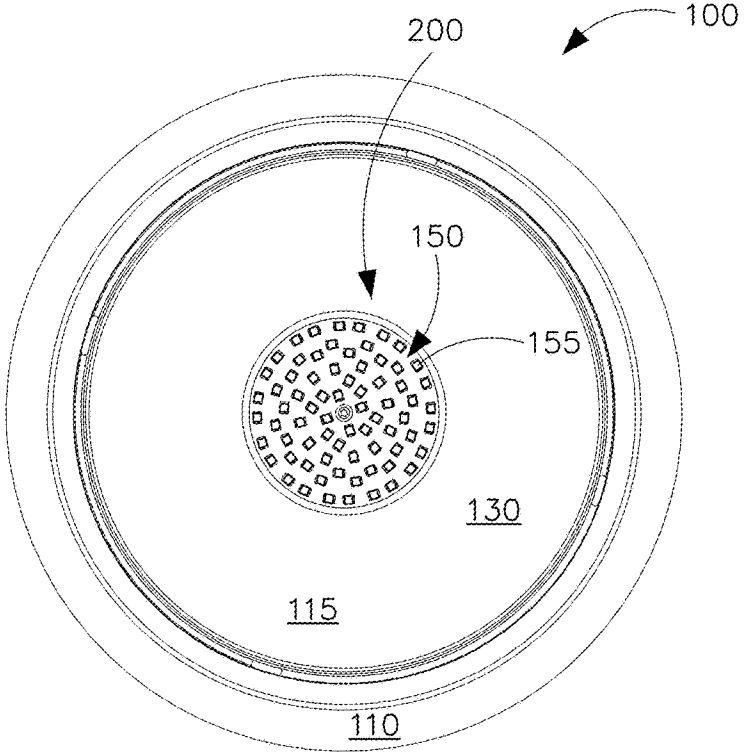
Figure 1F:
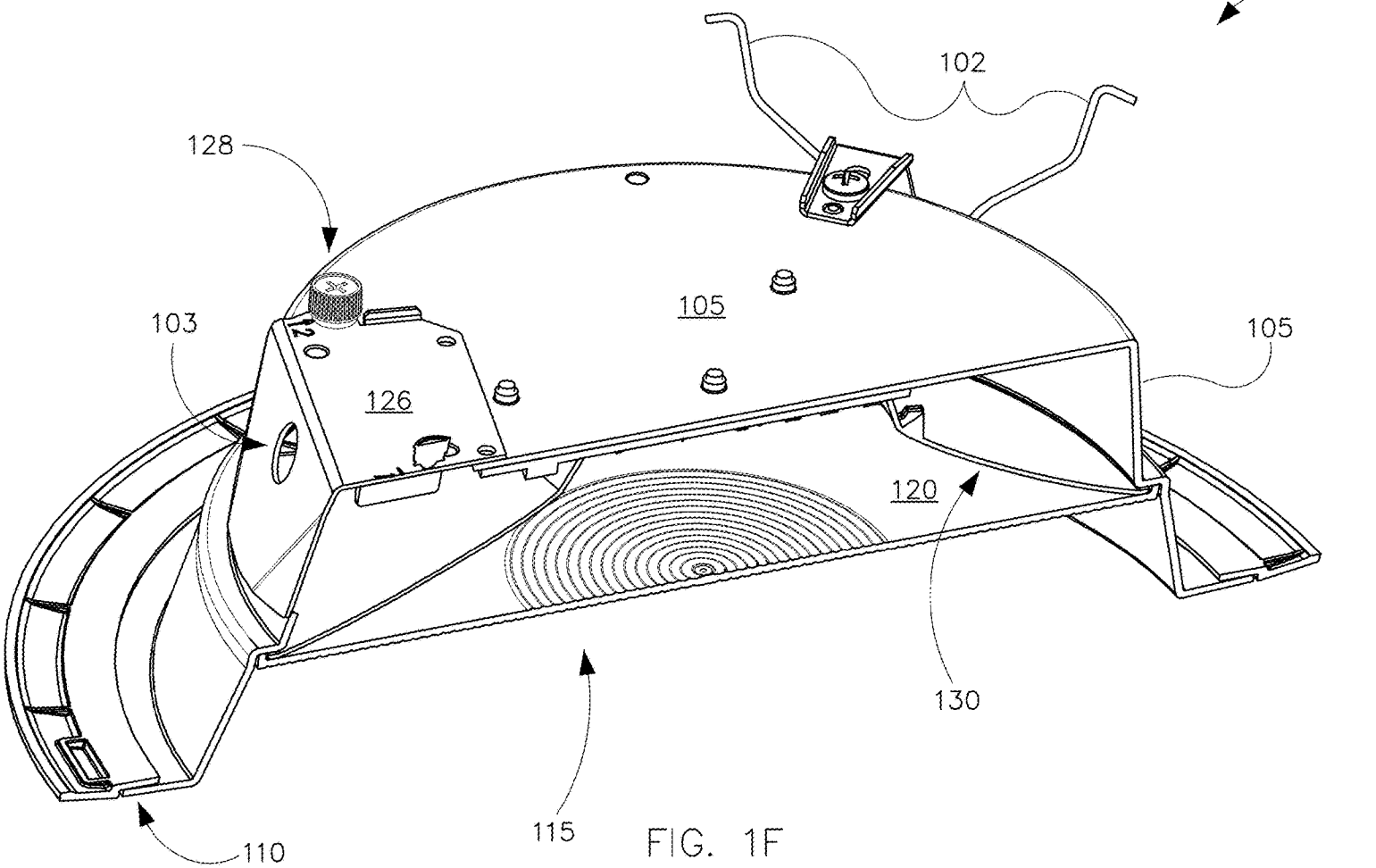
Figure 1G:
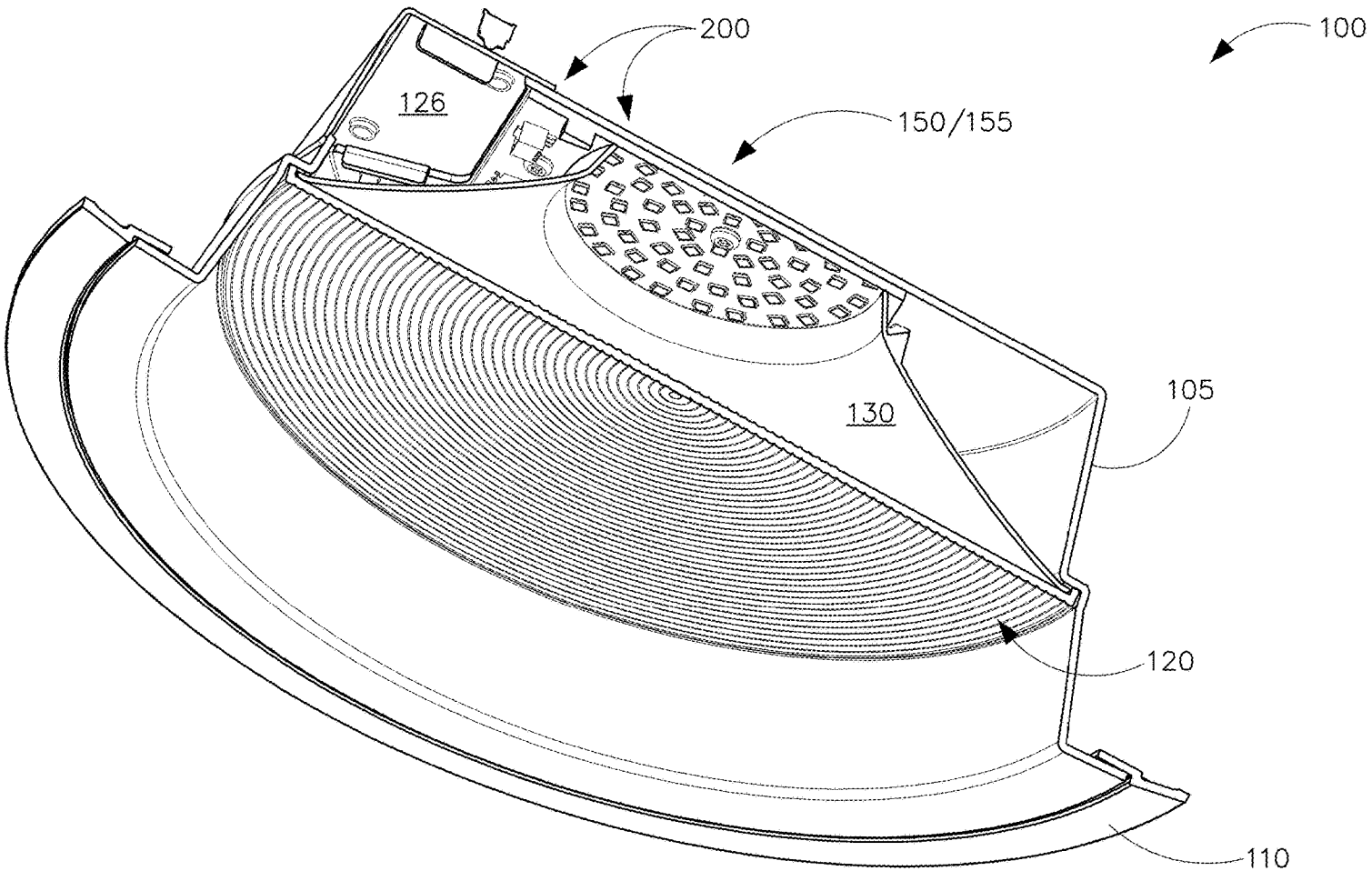
Figure 1H:
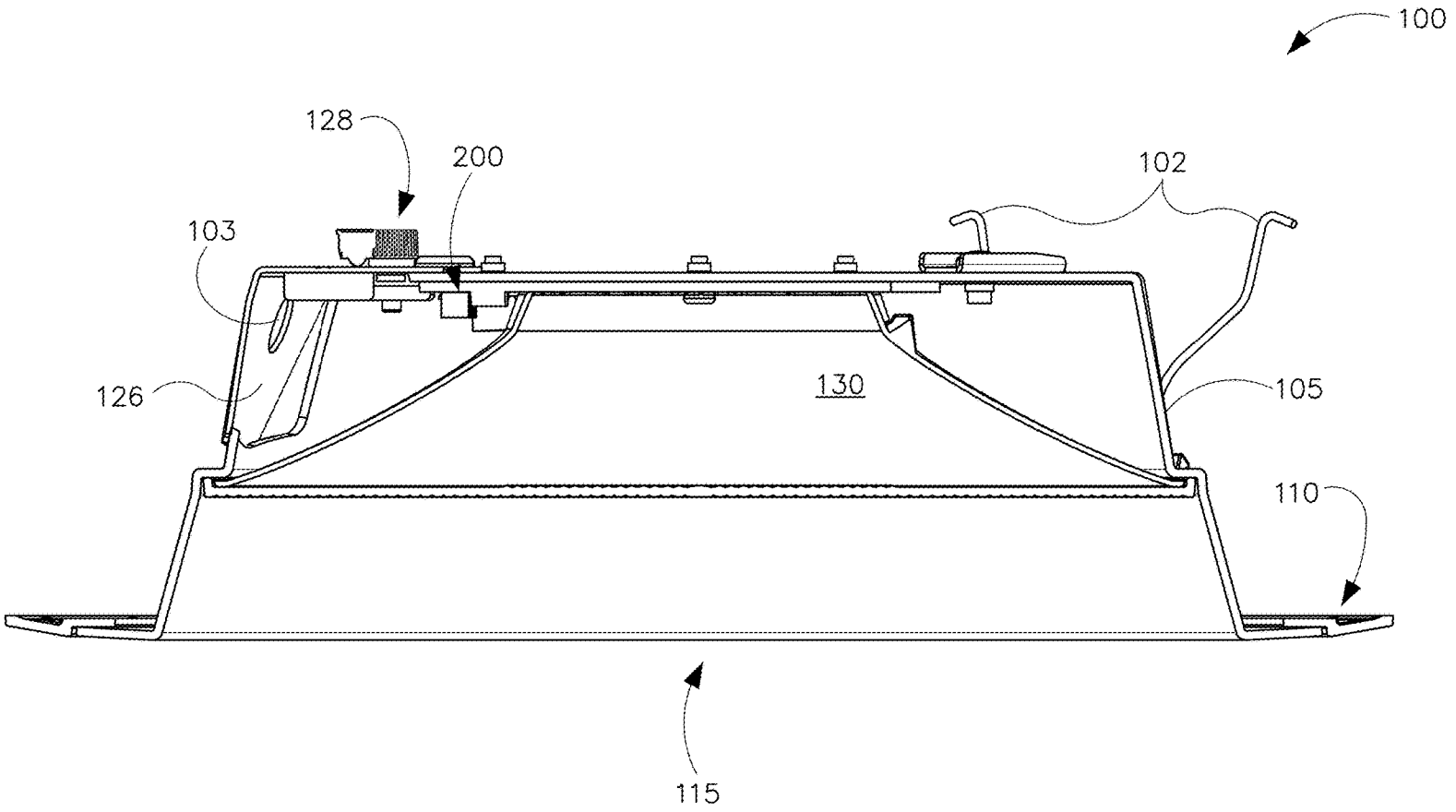

As best seen in the views of FIGS. 1A and 1B, the illustrated example luminaire 100 is suited for inserting in an aperture in a ceiling to provide overhead lighting. In this example embodiment, the luminaire 100 can be characterized as an overhead light or a recessed ceiling light. Various other indoor and outdoor luminaires that may be mounted in a wide range of orientations can be substituted for the luminaire 100 illustrated in FIG. 1.

The illustrated example luminaire 100 of FIG. 1 comprises a housing 105 that is circular with a protruding trim 110 that extends circumferentially about the housing 105. When the luminaire 100 is installed in a ceiling aperture, the rim 100 circumscribes and covers the edge of the ceiling aperture for aesthetics, for support, and for blocking of debris from above the ceiling. Hanger clips 102 hold the luminaire 100 in place in installation.

Figure 1J:
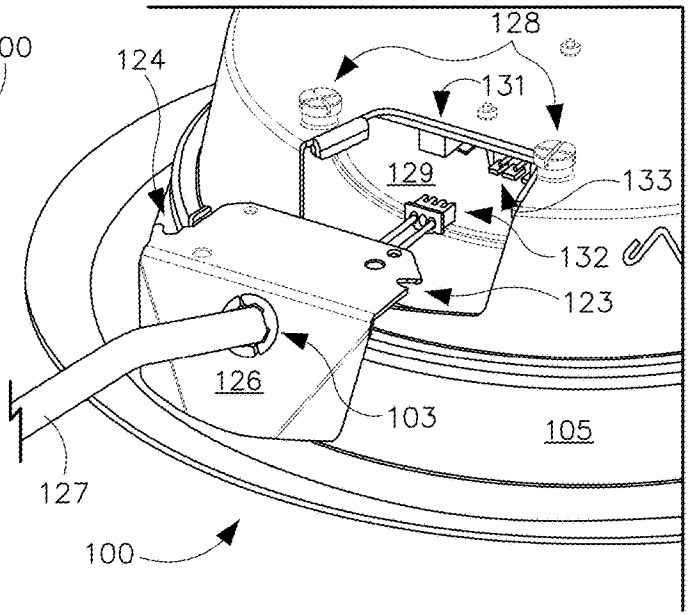
Figure 1I:
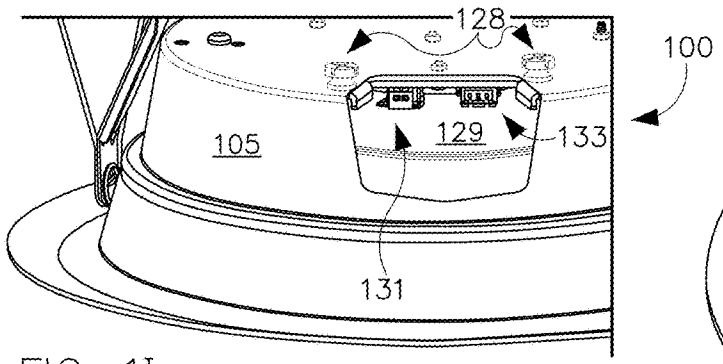
Figure 1K:
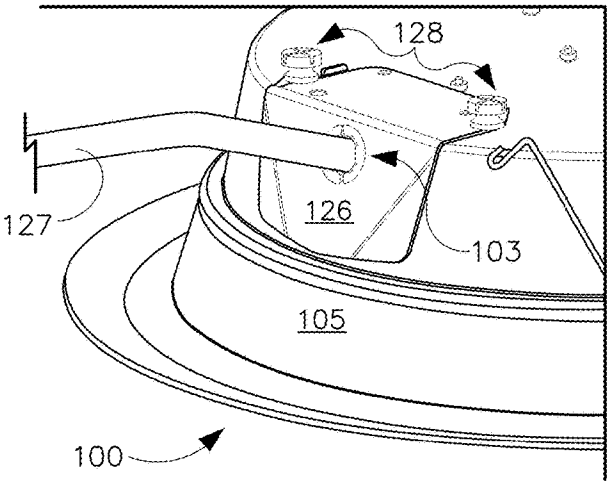

As best illustrated in FIGS. 1I, 1J, and 1K, the example luminaire 100 comprises an access aperture 129 and an associated cover 126. The access aperture 129 provides access to the interior of the luminaire housing 105, for example in the field and/or during luminaire installation. An installer can remove the cover 126 and manually set a dual inline pin (DIP) switch 131 to configure the luminaire 100 for long-term operation providing illumination with a selected color temperature, a selected lumen output, and/or a selected photometric distribution. As illustrated, the dual inline pin switch 131 is mounted on a circuit board adjacent the access aperture 129, thereby facilitating convenient and efficient access in the field or at a distribution center, for example.

An electrical cable 127 extends through a wiring aperture 103 in the cover 126. The electrical cable 127 terminates in a plug 132 that mates with a receptacle 133 that is mounted inside the housing 105 adjacent the access aperture 129 for convenient field access.

As illustrated, the example cover 126 comprises two notches 123, 124 that each receives a respective screw 128 for holding the cover 126 in place. The notch 123 is disposed on the right side of the cover 126 and is sized to receive one of the screws 128. Meanwhile, the notch 124 is disposed on a left side of the cover 126 and is sized to receive the other screw 128.

The left notch 124 and the right notch 123 are oriented so that the cover 126 is rotatable about the right screw 128 when the right screw 128 is loosely disposed in the right notch 123. In other words, cover rotation can occur when the right screw 128 is in the right notch 123 with threads engaged but prior to tightening. In this position, the cover 126 can rotate clockwise about the right screw 128. Thus, the right screw 128 provides an axis of rotation for the cover 126. This clockwise rotation facilitates convenient manipulation of the cover 126 by a person working the cover 126 to cover the access aperture 129, with the screws 128 engaged but not fully tightened. The clockwise rotation of the cover 126 about the right screw 128 provides the person with a capability to slide the left notch 124 of the cover 126 conveniently under the head of the left screw 128. Once the cover 126 is rotated so the left notch 124 is under the head of the left screw 128, the person (for example an installer) can tighten the two screws 128 to secure the cover 126.

To remove the cover 126, the person loosens the two screws 128 and then rotates the cover 126 counterclockwise about the right screw 128 so that the left notch 124 moves out from under the head of the left screw 128. Once the left notch 124 is free from the left screw 128, the installer can pull the right notch 123 out from under the right screw 128 to fully remove the cover 126.

As best seen in the views of FIGS. 1A, 1C, 1F, and 1G, the lens 120 of the luminaire 100 is positioned adjacent the lower, exit side of the light-emitting aperture 115. As illustrated, the lens 120 can mix and blend light emitted by two groups of light emitting diodes 150, 155, with each group having a different color temperature. In some embodiments, the two groups of light emitting diodes 150, 155 may have color temperatures that differ by at least 500 Kelvin, for example. The group of light emitting diodes 150 can be characterized as one light emitting diode light source, while the group of light emitting diodes 155 can be characterized as another light emitting diode light source. Other embodiments of a light emitting diode light source may have a single light emitting diode or more light emitting diodes than the embodiment illustrated in FIG. 1. A reflector 130 is disposed in and lines the aperture 115 to guide and manage the emitted light between the light emitting diodes 150, 155 and the lens 120. In some embodiments, an upper lens (not illustrated) replaces the reflector 130.

The light emitting diodes 150, 155 are mounted on a substrate 125, for example a circuit board, and form part of a circuit 200. In the illustrated embodiment, the light emitting diodes 150, 155 are interspersed. In other embodiments, the light emitting diodes 150, 155 may be separated from one another or spatially segregated according to color temperature or other appropriate parameter. As discussed in further detail below, the circuit 200 supplies electricity to the light emitting diodes 150, 155 with a level of flexibility that facilitates multiple configurations suited to different applications and installation parameters.

Figures 2, 3:
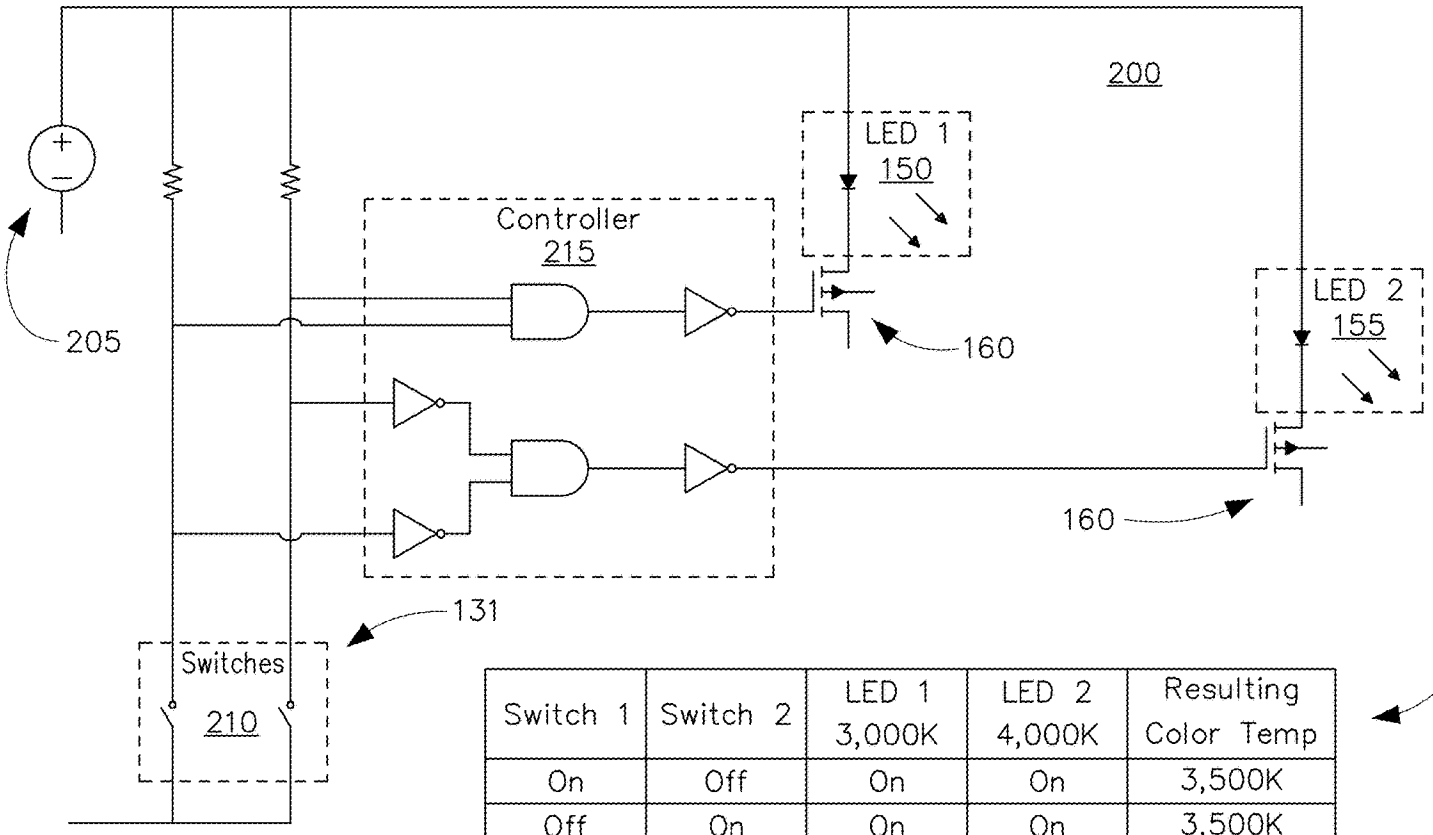
FIG. 2 illustrates a functional block diagram of a circuit that a luminaire can comprise in accordance with some example embodiments of the disclosure.
FIG. 3 illustrates a state table for a circuit that a luminaire can comprise in accordance with some example embodiments of the disclosure.
Figure 4:
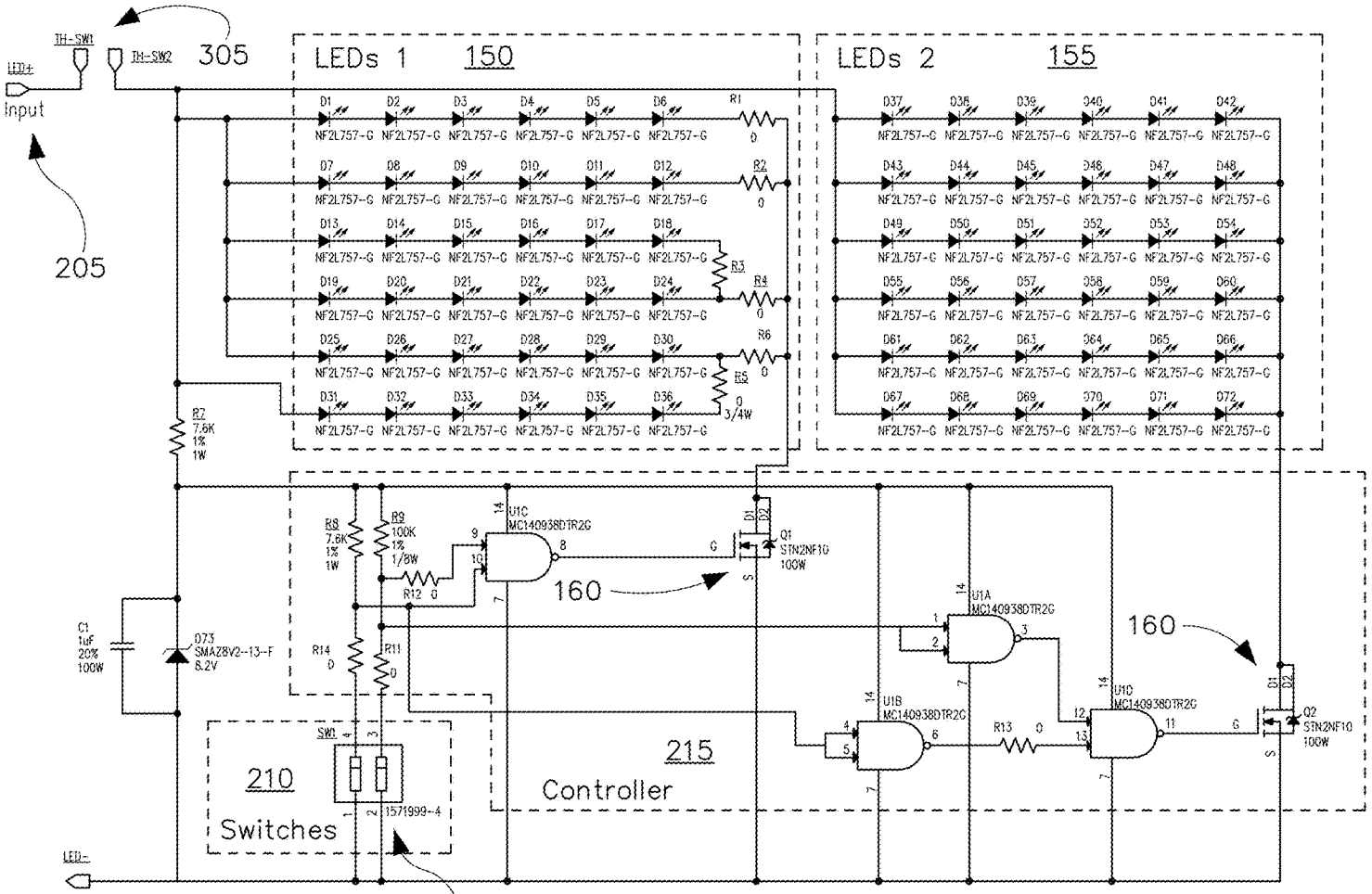
FIG. 4 illustrates a schematic of a circuit that a luminaire can comprise in accordance with some example embodiments of the disclosure.

Turning to FIGS. 2, 3, and 4, some example embodiments of the circuit 200 will be discussed in further detail with example reference to the luminaire 100. The circuit 200 can be applied to other indoor and outdoor luminaires.

Referring now to FIG. 2, this figure illustrates an embodiment of the circuit 200 in an example block diagram form. The circuit 200 comprises a DC power supply 205 for supplying electrical energy that the circuit 200 delivers to the light emitting diodes 150, 155. In an example embodiment, the circuit 200 comprises a light emitting diode driver.

The dual inline pin switch 131 comprises individual switches 210 that provide an input for configuring the luminaire 100 to operate at a selected color temperature. In the illustrated embodiment, the circuit 200 comprises two manual switches 210. Other embodiments may have fewer or more switches 210. In various embodiments, the switches 210 can be mounted to the housing 105 of the luminaire 100, for example within the housing 105 (as illustrated in FIG. 1 and discussed above) or on an exterior surface of the housing 105. In some embodiments, the switches 210 are mounted on the substrate 125. In some embodiments, the switches 210 are implemented via firmware or may be solid state.

As an alternative to the illustrated dual inline pin switch 131, the input can comprise multiple DIP switches, one or more single in-line pin packages (SIP or SIPP), one or more rocker switches, one or more reed switches, one or more magnetic switches, one or more rotary switches, one or more rotary dials, one or more selectors or selector switches, one or more slide switches, one or more snap switches, one or more thumbwheels, one or more toggles or toggle switches, one or more keys or keypads, or one or more buttons or pushbuttons, to mention a few representative examples without limitation.

As further discussed below, a controller 215 operates the light emitting diodes 150, 155 according to state of the switches 210. In some example embodiments, the controller 215 comprises logic implemented in digital circuitry, for example discrete digital components or integrated circuitry. In some example embodiments, the controller 215 utilizes microprocessor-implemented logic with instructions stored in firmware or other static or non-transitory memory.

In the illustrated embodiment, the outputs of the controller 215 are connected to two MOSFET transistors 160 to control electrical flow through two light emitting diodes 150, 155. The illustrated MOSFET transistors 160 provide one example and can be replaced with other appropriate current control devices or circuits in various embodiments. The switches 210 thus configure the luminaire 100 to operate with either or both of the light emitting diodes 150, 155. The light emitting diodes 150, 155 illustrated in FIG. 2 may represent two single light emitting diodes or two groups of light emitting diodes, for example.

FIG. 3 illustrates a representative table 300 describing operation of the circuit 100 according to some example embodiments. In the example of FIG. 3, the light emitting diode 150 produces light having a color temperature of 3,000 Kelvin, and the light emitting diode 155 produces light having a color temperature of 4,000 Kelvin.

As shown in the example table 300, when both of the switches 210 are in the on state, the controller 215 causes the light emitting diode 155 to be off and the light emitting diode 150 to be on. Accordingly, the luminaire 100 emits illumination having a color temperature of 3,000 Kelvin.

When both of the switches 210 are in the off state, the controller 215 causes the light emitting diode 155 to be on and the light emitting diode 150 to be off. Accordingly, the luminaire 100 emits illumination having a color temperature of 4,000 Kelvin.

When one of the switches 210 is in the off state and the other of the switches 210 is on the on state, the controller 215 causes the light emitting diode 155 to be on and the light emitting diode 150 to be on. The luminaire 100 thus emits illumination having a color temperature of 3,500 Kelvin. In some other example embodiments, the controller 215 can adjust the light output of one or both of the light emitting diodes 150, 155 to set the color temperature to a specific value with the range of 3,000 to 4,000 Kelvin.

Accordingly, the controller 215 maps the four configurations of the two switches 210 to three states for configuring the two light emitting diodes 150, 155 for permanent or long-term operation. Mapping two switch configurations to a single mode of long-term operation can simplify configuration instructions and reduce errors during field configuration. The resulting configurations support multiple color temperatures of illumination from a single luminaire 100.

Some example embodiments support fewer or more than three states of illumination. For example, in one embodiment, the luminaire 100 comprises three strings of light emitting diodes 150 that have different color temperatures, such as 3,000 Kelvin, 2,700 Kelvin, and 4,000 Kelvin. In this example, in addition to the states illustrated in FIG. 3 and discussed above, the switching logic can support a fourth state in which only the 2,700 Kelvin string is on.

FIG. 4 illustrates a schematic of an example embodiment of the circuit 200. The schematic of FIG. 4 provides one example implementation of the block diagram illustrated in FIG. 3.

As illustrated in FIG. 4 in schematic form, the circuit 200 conforms to the foregoing discussion of the block diagram format of FIG. 3. In FIG. 4, the light emitting diodes 150, 155 of FIG. 3 are respectively represented with groups of light emitting diodes 150, 155. Additionally, the schematic details include a thermal protective switch 305 for guarding against overheating. FIG. 4 thus provides one example schematic for an embodiment of the electrical system of the luminaire 100 illustrated in FIG. 1 and discussed above.

Figure 5:
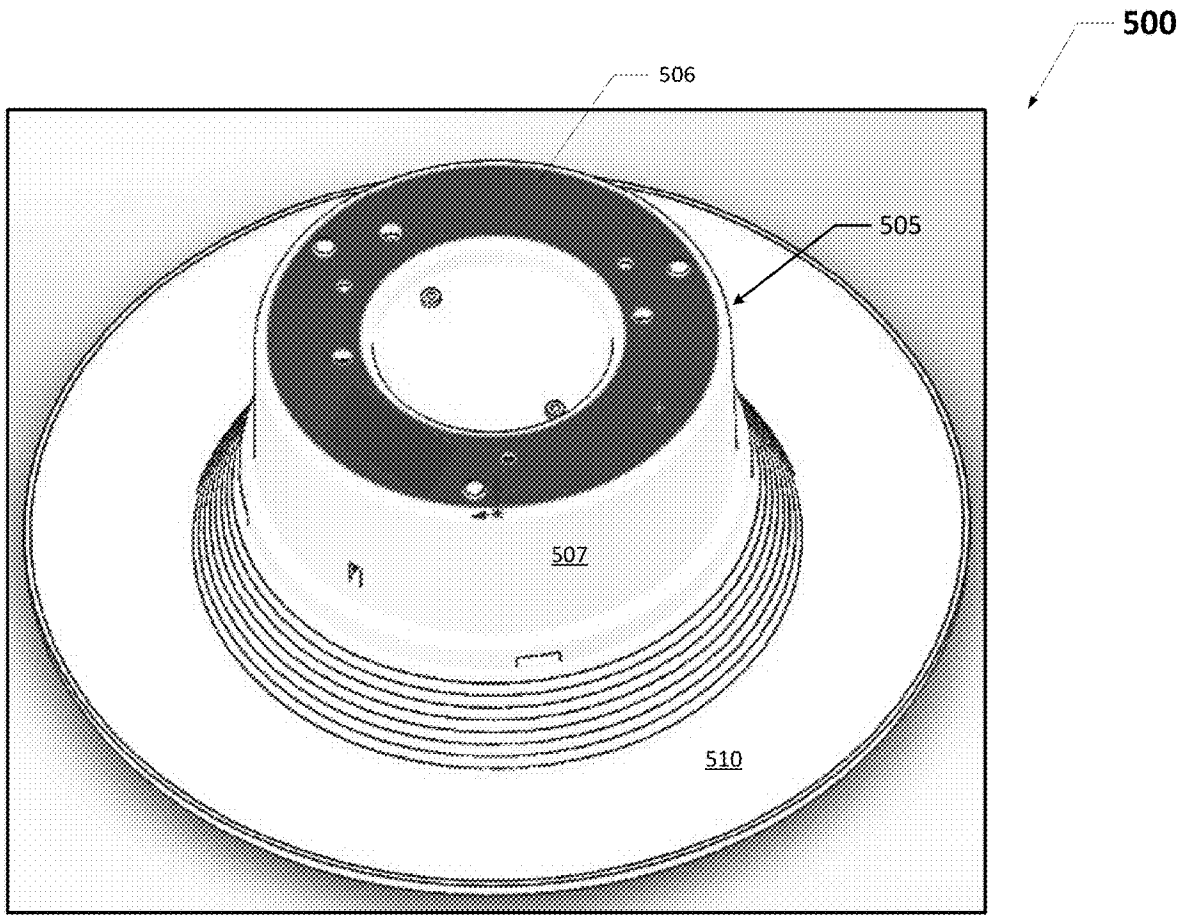
FIG. 5 (PRIOR ART)
FIG. 5 shows a luminaire currently known in the art.

FIG. 5 shows a luminaire 500 currently known in the art. Referring to FIGS. 1A-5, the luminaire 500 of FIG. 5 can include a housing 505 (also called an enclosure 505) that is cylindrical in shape, having a top surface 506 (also sometimes called a top wall 506 or a top outer surface 506) and a side surface 507 (also sometimes called a side wall 507 or a side outer surface 507). These various surfaces of the housing 505 form a cavity.

Coupled to the bottom end of the housing 505 of FIG. 5 is a trim 510 (substantially similar to the trim 110 shown in FIGS. 1A-1K above). As with the luminaire 100 of FIGS. 1A-1K, the luminaire 500 (sometimes also called a light fixture 500) can include one or more of a number of other components, including but not limited to a lens, a reflector, a controller, an energy storage device (e.g., battery), a power module (e.g., a LED driver), a sensor, and a number of LEDs. One or more of such components can be disposed within a cavity formed by one or more surfaces (e.g., top surface 506, side surface 507) of the housing 505, disposed on a portion (e.g., the housing 505, the trim 510) of the luminaire 500, and/or physically remote from but in communication with the luminaire 500.

Figure 6A:
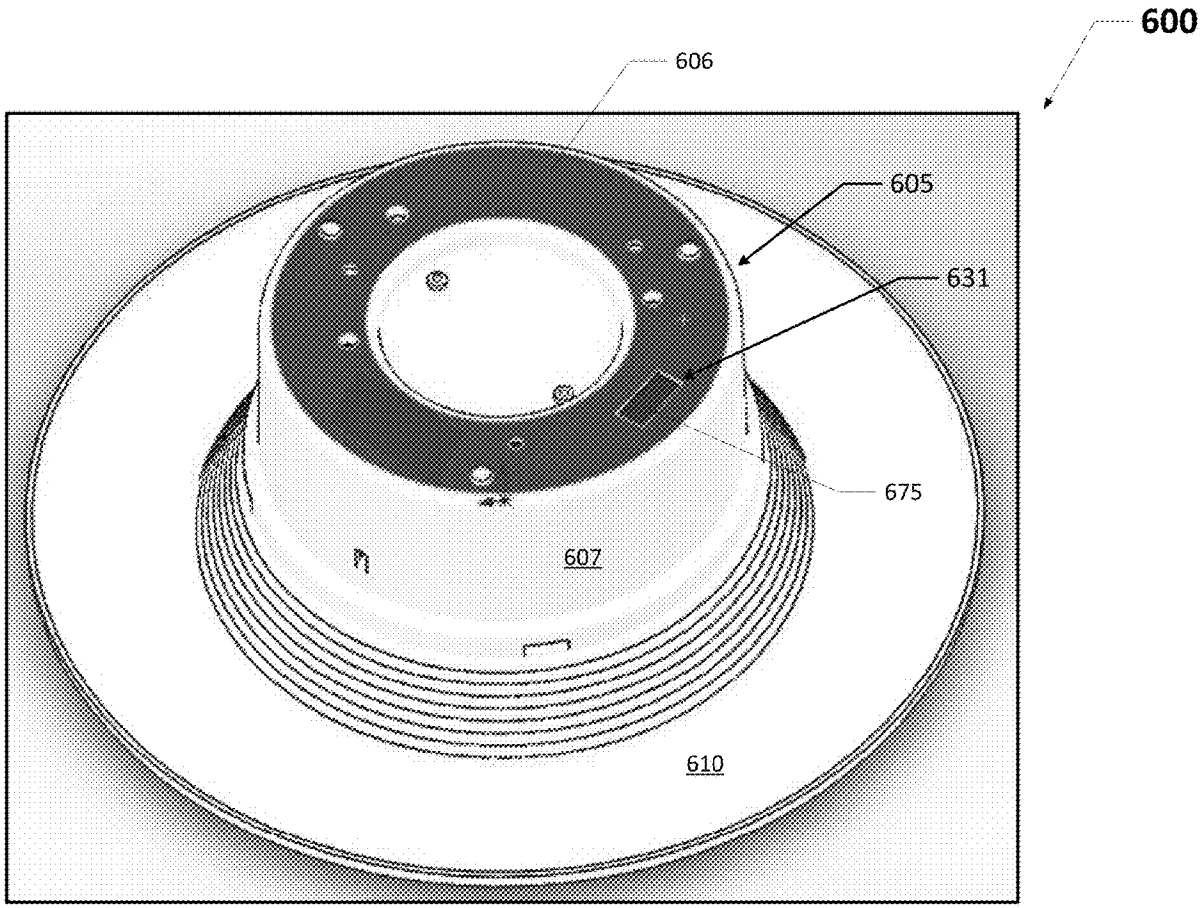
FIGS. 6A-6C show a luminaire that includes a switch in accordance with certain example embodiments.
Figure 6B:
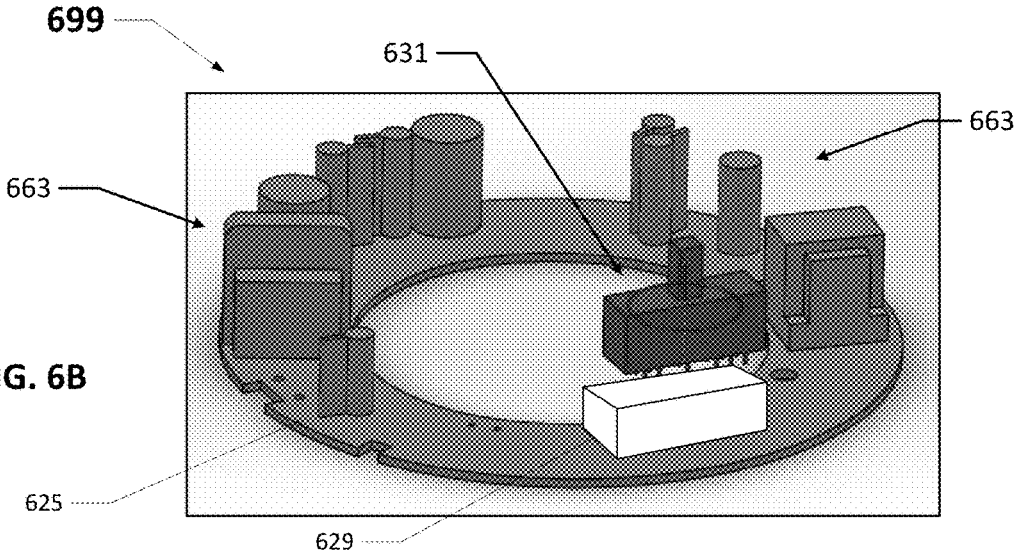
Figure 6C:
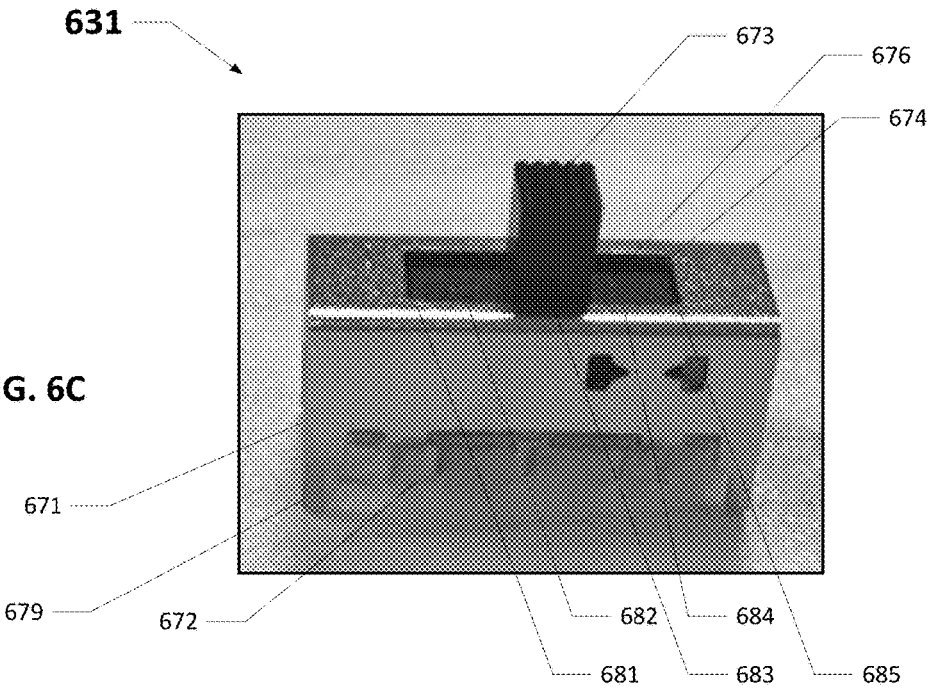

FIGS. 6A-6C show a luminaire 600 that includes a switch 631 in accordance with certain example embodiments. Specifically, FIG. 6A shows a top-side perspective view of the luminaire 600. FIG. 6B shows a partially-exploded top-side perspective view of a circuit board assembly 699 of the luminaire 600. FIG. 6C shows a top-side perspective view of the switch 631.

Referring to FIGS. 1A-6C, the luminaire 600 of FIG. 6A is substantially the same as the luminaire 500 of FIG. 5, except as described below. For example, the luminaire 600 of FIG. 6A can include a housing 605 that is cylindrical in shape, having a top surface 606 and a side surface 607. Coupled to the bottom end of the housing 605 of FIG. 6A can be a trim 610. The housing 605 can be made of one or more of a number of thermally conductive materials (e.g., stainless steel, aluminum). In such a case, the housing 605 can act as a heat sink, absorbing heat generated by one or more components (e.g., LEDs, power modules, hardware processor, energy storage device) in thermal communication with the housing 605, and subsequently dissipating the absorbed heat into the ambient environment.

As with the luminaires discussed above, the luminaire 600 can include one or more of a number of other components. Such components can be disposed within a cavity formed by the housing 605, disposed on a portion (e.g., the housing 605, the trim 610) of the luminaire 600, and/or physically remote from but in communication with the luminaire 600. In this case, as shown in FIGS. 6A-6C, some of those other components include a switch 631 and a number of other electrical components 663 (e.g., controller, capacitors, resistors, diodes, transistors, integrated circuits, hardware processor) disposed on a substrate 625.

The substrate 625, the electrical connector 629, the other electrical components 663, and part of the switch 631 in this case are disposed within a cavity formed by the housing 605. In order for a user to be able to access the switch 631, at least part of the switch 631 can be disposed within and protrude through an aperture 675 in a wall (in this case, the top surface 606) of the housing 605. As an alternative, part of the switch 631 can protrude through an aperture in the side surface 607 of the housing 605. Permitting a user to access the switch 631 protruding through the aperture 675 in the housing 605 facilitates configuration of the luminaire 600 and avoids the need to open and/or disassemble the luminaire 600.

The example switch 631 can be used to select one or more of a number of variables that affect the operation of the luminaire 600. For example, the switch 631 can be used to select one of a number of CCTs. The switch 631 can be any of a number of types of switches, including but not limited to one or more DIP switches, one or more SIPP switches, one or more rocker switches, one or more reed switches, one or more magnetic switches, one or more rotary switches, one or more rotary dials, one or more selectors or selector switches, one or more slide switches (as shown in FIG. 6C), one or more snap switches, one or more thumbwheels, one or more toggles or toggle switches, one or more keys or keypads, and one or more buttons or pushbuttons.

As mentioned above, the switch 631 of FIGS. 6A-6C is a slide switch. The switch 631 has a body 671 and a number of coupling features 672 (in this case, pins) disposed on the bottom of the body 671 that allow the switch 631 to become electrically coupled to an electrical connector 629 on the substrate 625 (and therefore also to one or more of the other components 663 mounted on the substrate 625, such as a controller, as described above). In some cases, adjacent to the coupling features 672 can be disposed one or more mechanical coupling features 679 (e.g., tabs, posts). In such a case, mechanical coupling features 679 can act as guides to properly position and align the coupling features 672 of the switch 631 relative to an electrical connector 629 mounted on the substrate 625. At the top end of the body 671 is an actuator 673 that extends outward from a plate 676. The plate 676 is disposed within the body 671 and has a length that is less than the length of the body 671. The plate 676 also corresponds to a slot 674 that traverses the top end of the body 671. The actuator 673 extends through the slot 674 and can be accessible by a user.

The switch 631 can include a number of detents and/or other features to limit or create discrete stopping locations for the actuator 673 (and so also the plate 676) along the length of the slot 674. Each of these detents and/or other features can be associated with a certain value of a variable that affects the operation of the luminaire 600. For example, if the switch 631 is used to select a CCT, the left end 681 of the slot 674 can be associated with 5000 K, detent 682 can be associated with 4000 K, detent 683 can be associated with 3500 K, detent 684 can be associated with 3000 K, and right end 685 of the slot 674 can be associated with 2700 K.

Figure 7:
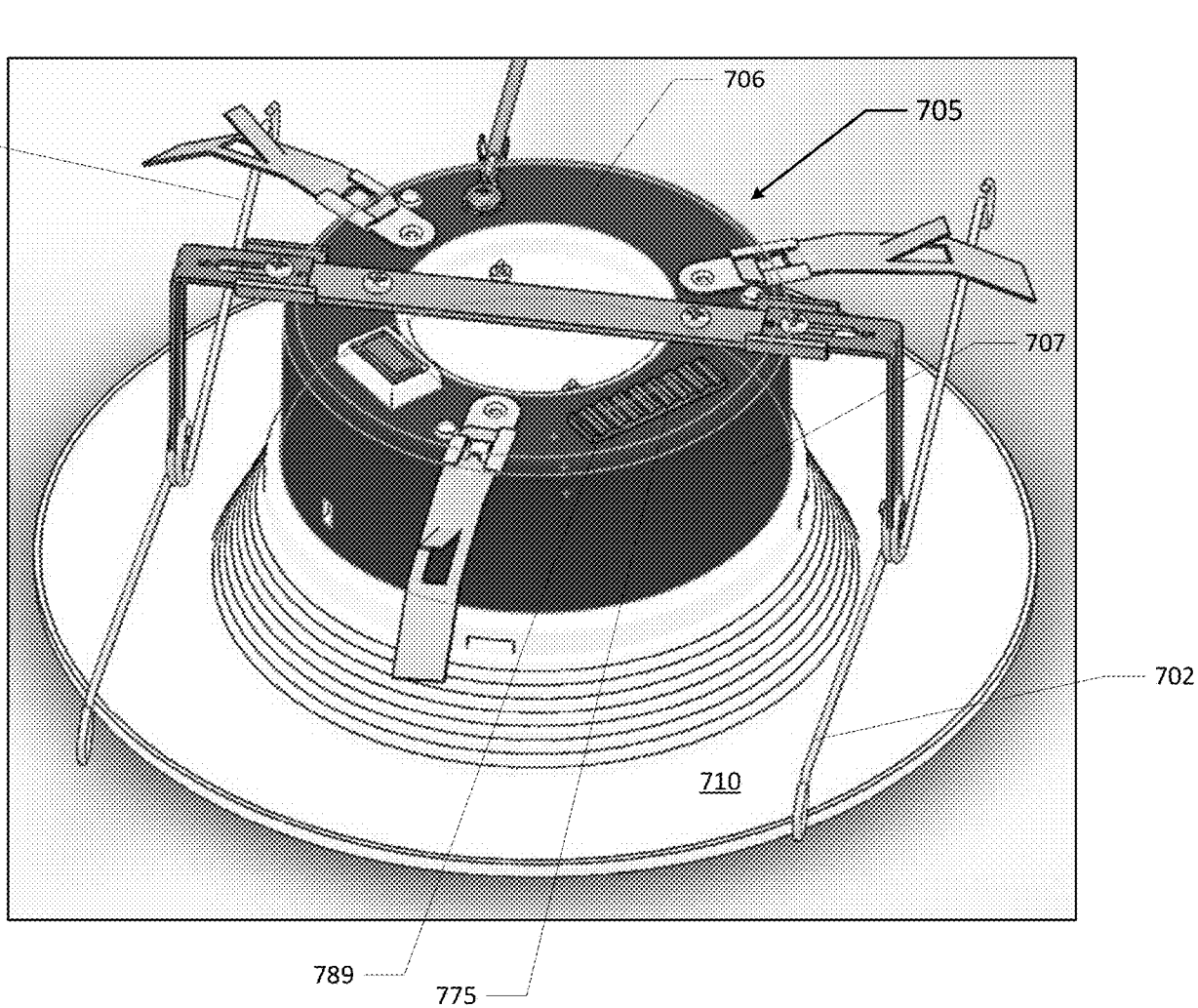
FIG. 7 shows a luminaire that is configured to receive a switch in accordance with certain example embodiments.

Example switches 631 can be used with a new luminaire 600. Alternatively example switches 631 can be retrofit into existing luminaires. Also, while FIGS. 6A-6C show that the switch 631 is disposed within and coupled to the housing 605, the switch 631 can alternatively be disposed within and/or coupled to some other portion (e.g., the trim 610) of the luminaire 600. In some cases, a luminaire can be manufactured without the switch, but with the ability to receive an example switch at a later time (e.g., during installation). For example, FIG. 7 shows a luminaire 700 that is configured to receive a switch in accordance with certain example embodiments. Referring to FIGS. 1A-7, the luminaire 700 can be substantially the same as the luminaires discussed above, except as described below.

For example, the luminaire 700 of FIG. 7 can include an housing 705 that is cylindrical in shape, having a top surface 706 and a side surface 707. Coupled to the bottom end of the housing 705 of FIG. 7 can be a trim 710. Further, hanger clips 702 can be used to hold the luminaire 700 in place upon installation. In this case, the example switch is not coupled to the luminaire 700. Instead, there is a removable plug 789 disposed in the aperture 775 that traverses the top surface 706 of the housing 705. The removable plug 789 can be used to keep dust and other elements in the ambient environment from entering the cavity formed by the housing 705.

In such a case, when a user (e.g., an installer, an electrician, a homeowner) wants to install an example switch on the luminaire 700, the removable plug 789 can easily be removed (with or without a tool), and the example switch can be inserted into the connector inside the housing 705 that is subsequently exposed. Example switches can be incorporated into any of a number of different types of luminaires (light fixtures). For example, as shown in FIGS. 6A-7, example switches can be used with down light fixtures. Other types of luminaires that can be used with example switches can include, but are not limited to, troffer lights, under cabinet lights, pendent lights, recessed lights, and wall scones, As will be appreciated by those of ordinary skill, the textual and illustrated disclosure provided herein supports a wide range of embodiments and implementations. In some non-limiting example embodiments of the disclosure, a luminaire can comprise: a housing; a substrate disposed in the housing; a first plurality of light emitting diodes that are mounted to the substrate and that have a first color temperature; a second plurality of light emitting diodes that are mounted to the substrate and that have a second color temperature; and a plurality of manual switches that are disposed at the housing for permanently configuring the luminaire to: provide illumination of the first color temperature by enabling the first plurality of light emitting diodes; provide illumination of the second color temperature by enabling the second plurality of light emitting diodes; and provide illumination of a third color temperature that is between the first color temperature and the second color temperature by enabling the first plurality of light emitting diodes and the second plurality of light emitting diodes.

In some example embodiments of the luminaire, the housing can comprise an aperture that is configured for emitting area illumination, and the substrate is oriented to emit light through the aperture. In some example embodiments of the luminaire, the plurality of manual switches are mounted to the substrate. In some example embodiments of the luminaire, the plurality of manual switches are mounted in the housing. In some example embodiments of the luminaire, the plurality of manual switches are mounted to the housing. In some example embodiments of the luminaire, the plurality of manual switches comprise a dual inline pin (DIP) switch.

In some example embodiments of the luminaire, the plurality of manual switches provide two switch states, and each of the two switch states provides illumination of the third color temperature by enabling the first plurality of light emitting diodes and the second plurality of light emitting diodes. In some example embodiments of the luminaire, the housing is circular and comprises a lip configured for extending around an aperture in a ceiling. In some example embodiments of the luminaire, the housing comprises a wiring port disposed on a side of the housing. In some example embodiments of the luminaire, the housing comprises a light-emitting aperture in which the substrate is disposed.

In some example embodiments, the luminaire further comprises: an aperture disposed at a lower side of the housing; a lens disposed at the aperture for refracting light emitted by the first and second light emitting diodes; and a reflector that is disposed between the lens and the light emitting diodes and that is operative to reflect light between the first and second light emitting diodes and the lens. In some example embodiments of the luminaire, the housing is circular and comprises a lip configured for extending around an aperture in a ceiling. In some example embodiments of the luminaire, the housing comprises a wiring port disposed on a side of the housing. In some example embodiments of the luminaire, the housing forms a cavity associated with the aperture. In some example embodiments of the luminaire, the first and second light source are mounted to a substrate that is disposed at an end of the cavity. In some example embodiments, the luminaire further comprises a reflector that is disposed in the cavity between the lens and the first and second light sources, the reflector operative to reflect light between the first and second light sources and the lens.

Technology for providing a configurable a luminaire has been described. Many modifications and other embodiments of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A luminaire comprising:

a housing comprising at least one outer surface that forms a cavity;

an aperture that traverses the at least one outer surface of the housing;

a substrate disposed within the cavity;

an electrical connector disposed on the substrate adjacent to the aperture; and a switch coupled to the electrical connector, wherein switch has multiple positions, wherein each position of the switch corresponds to a discrete correlated color temperature (CCT) output by a plurality of light sources of the luminaire.

2. The luminaire of claim 1, wherein the switch is a single component.

3. The luminaire of claim 2, wherein the switch is a slide switch.

4. The luminaire of claim 3, wherein when the switch has a first position, a second position, a third position, a fourth position, and a fifth position.

5. The luminaire of claim 4, wherein the first position of the switch corresponds to 2700 Kelvin (K) output by the plurality of light sources, wherein the second position of the switch corresponds to 3000 K output by the plurality of light sources, wherein the third position of the switch corresponds to 3500 K output by the plurality of light sources, wherein the fourth position of the switch corresponds to 4000 K output by the plurality of light sources, and wherein the fifth position of the switch corresponds to 5000 K output by the plurality of light sources.

6. The luminaire of claim 1, wherein the switch is removably coupled to the electrical connector.

7. The luminaire of claim 1, further comprising:

a removable plug disposed in the aperture that traverses the at least one outer surface of the housing when the switch is decoupled from the electrical connector.

8. The luminaire of claim 7, wherein the plug and the switch are removable by a user without tools.

9. The luminaire of claim 1, wherein the aperture traverses a top outer surface of the housing.

10. The luminaire of claim 1, wherein the switch is coupled to the electrical connector during installation of the luminaire.

11. The luminaire of claim 1, wherein the switch is inaccessible when the luminaire is installed.

12. The luminaire of claim 1, wherein the switch comprises an actuator, wherein the actuator of the switch is disposed outside the cavity.

13. A switch for controlling a correlated color temperature (CCT) of light emitted by a luminaire, the switch comprising:

a body;

at least one first coupling feature disposed on a bottom end of the body, wherein the at least one first coupling feature is configured to electrically couple to an electrical connector of the luminaire; and an actuator disposed on the body, wherein the actuator has a plurality of positions relative to the body, wherein each position of the plurality of positions of the actuator corresponds to a CCT of the light emitted by the luminaire.

14. The switch of claim 13, wherein the actuator is coupled to a plate disposed within the body, wherein the actuator extends through a slot that traverses an outer surface of the body.

15. The switch of claim 14, wherein the plate has at least one detent.

16. The switch of claim 13, further comprising:

at least one second coupling feature disposed adjacent to the at least one first coupling feature, wherein the at least one second coupling feature is configured to align the at least one first coupling feature relative to the electrical connector of the luminaire.

17. The switch of claim 13, wherein the plurality of positions of the switch comprise a first position, a second position, a third position, a fourth position, and a fifth position.

18. A luminaire comprising:

a housing comprising at least one outer surface that forms a cavity;

a plurality of light sources;

an aperture that traverses the at least one outer surface of the housing;

a substrate disposed within the cavity; and an electrical connector disposed on the substrate adjacent to the aperture, wherein the electrical connector is configured to couple to a switch, wherein the switch has multiple positions, wherein each position of the switch corresponds to a discrete correlated color temperature (CCT) output by the plurality of light sources.

19. The luminaire of claim 18, further comprising:

a removable plug removably disposed in the aperture that traverses the at least one outer surface of the housing.

20. The luminaire of claim 18, wherein the electrical connector is located relative to the aperture such that an actuator of the switch, when coupled to the electrical connector, is disposed outside the cavity.

* * * * *